US007192282B2

(12) United States Patent
Cederwall

(10) Patent No.: US 7,192,282 B2
(45) Date of Patent: Mar. 20, 2007

(54) DEVICE AND METHOD FOR WEAPON SIGHT

(75) Inventor: Per Cederwall, Jönköping (SE)

(73) Assignee: Saab AB, Linkoping (SE)

( * ) Notice: Subject to any disclaimer, the term of this patent is extended or adjusted under 35 U.S.C. 154(b) by 191 days.

(21) Appl. No.: 10/851,189

(22) Filed: May 24, 2004

(65) Prior Publication Data

US 2005/0011103 A1 Jan. 20, 2005

(30) Foreign Application Priority Data

May 23, 2003 (SE) ..... 0301534

(51) Int. Cl.
*F41A 33/06* (2006.01)

(52) U.S. Cl. ..... 434/18; 434/21; 89/41.19

(58) Field of Classification Search ..... 397/837; 434/21, 18; 89/41.11, 41.19
See application file for complete search history.

(56) References Cited

U.S. PATENT DOCUMENTS

| | | | | |
|---|---|---|---|---|
| 3,629,959 A | | 12/1971 | Essonne et al. | |
| 3,798,796 A | | 3/1974 | Stauff et al. | |
| 4,048,489 A | | 9/1977 | Giannetti | 240/6.41 |
| 4,464,974 A | | 8/1984 | Goda | 244/3.11 |
| 4,917,609 A | * | 4/1990 | Eichweber | 434/20 |
| 6,450,816 B1 | * | 9/2002 | Gerber | 434/11 |
| 6,914,731 B2 | * | 7/2005 | Fredriksson | 359/754 |

FOREIGN PATENT DOCUMENTS

| | | | |
|---|---|---|---|
| DE | 4111935 A1 | | 10/1992 |
| FR | 2275747 | | 1/1976 |
| GB | 1264084 | | 2/1972 |
| GB | 2 159 255 A | * | 11/1985 |
| SE | 450168 | | 6/1987 |
| SE | 459 450 B | | 7/1989 |
| SE | 459450 | | 7/1989 |

* cited by examiner

*Primary Examiner*—Stephen M. Johnson
(74) *Attorney, Agent, or Firm*—Bingham McCutchen LLP

(57) ABSTRACT

This invention concerns a device for a weapon sight. The device includes a deflecting element (15) disposed in an optical path through the sight and comprising an optical wedge (17), and means (16) arranged to control the positional setting of the optical wedge to produce a randomly altered sight image in the sight. The device is characterized in that the control means (16) are arranged to produce, before firing, the altered sight image and, during firing, to guide the wedge or wedges to a reference position in which the sight image is unaltered. The invention also concerns a method for optically simulating recoil in a weapon with a sight.

14 Claims, 4 Drawing Sheets

DEVICE AND METHOD FOR WEAPON SIGHT

BACKGROUND OF THE INVENTION

The present invention relates to a device for a weapon sight which includes a deflecting element disposed in an optical path through the sight, and control means arranged to control the deflecting element so as to produce a randomly altered sight image in the sight. The invention also relates to a method for optically simulating recoil in a weapon with a sight.

DESCRIPTION OF THE RELATED ART

When a live weapon is fired, a disruptive motion, so-called "recoil", occurs as a result of the weight and center of gravity changes that arise when the projectile is fired from the weapon. With respect to all types of replica weapon simulations of non-recoilless weapons, the realism of the simulation is heightened if the shooter experiences the recoil associated with the original weapon when firing the replica. The replica weapon replicates the original weapon in terms of its appearance, handling and control, aiming means, weight and balance. The replica weapon can also be equipped with a laser simulator, graphic simulator or positioning simulator.

It is important to simulate the recoil as realistically as possible during firing practice and combat training. The simulator must induce the shooter to handle the weapon correctly, so that he receives practice in supporting the weapon sufficiently and executes a precisely balanced aiming procedure both during firing and, if he is training with a guided weapon, during the entirety of the flight of the projectile to the target.

Spring-based solutions are currently available to simulate recoil, in which mechanically stored spring energy is released upon firing. Devices that utilize these solutions, however, weigh a great deal and are also space-intensive. Moreover, they are prone to wear and last for only a limited number of firings. Tensioning the spring mechanism is also energy-intensive and time-consuming.

SE 459 450 describes a device in which a deflecting element randomly affects the line of sight of a weapon in order to simulate the recoil of the weapon, and in which blinding elements are arranged to simulate target image loss for a predetermined length of time that begins at an initial moment preceding the random effect of the deflecting element and ends at a second moment that occurs after the effect of the deflecting element has been initiated. The deflecting element can comprise two actuatable, rotatable wedges, each of which can be actuated by its own motor. The motors are arranged to actuate the rotatable wedges randomly and differently for each firing instance. The device is arranged to be used in connection with the firing of guided projectiles, in which case the weapon is kept aimed at the target not only at the moment of firing, but also during the entire flight of the projectile toward the target.

SUMMARY OF THE INVENTION

The present invention improves the simulation of recoil and disengagement so that an individual who is practicing firing with a firing simulator disposed on a weapon or replica weapon will practice correct behavior.

One aspect of the invention is a device for simulating an optical recoil in a weapon sight which includes a deflecting element disposed in an optical path through the sight and comprising at least one optical wedge, and means arranged to control the positional setting of the optical wedge so as to produce a randomly altered sight image in the sight.

The term "weapon sight" includes both the sight of a weapon for firing with live ammunition and the associated simulator sight mounted on the weapon or replica weapon. The fact that the deflecting element is disposed in an optical path through the sight entails that the deflecting element can be disposed either directly in front of or behind the sight, or inside the sight. However, to prevent the image viewed through the sight from being distorted, the deflecting element should be disposed in a location such that the beam path is parallel.

The control means are arranged to produce the altered sight image before firing and, during firing, to guide the wedge or wedges to their respective reference positions, in which the sight image is not altered. In one embodiment of the simulated optical recoil according to the invention, the deflecting element thus skews the beam path prior to firing in a random fashion. After firing, the skew resumes the non-skewed reference position. The system thereby retains its reference/precision relative to a reference axis of a laser simulator unit on the weapon throughout the entire flight to the target, when hit assessment is performed. This is particularly important in connection with types of weapons for which the weapon must be kept aimed at the target not only during the moment of firing but also during the entire flight of the guided projectile toward the target.

According to one embodiment, the control means consist of at least one memory arranged to store the current positional setting of each wedge. In order to enable the wedges to return to the reference position during firing, the control means are arranged to retrieve the stored positional settings from the memory and, for each wedge, to apply an equally large but counter directional displacement to the reference position.

The positional settings of the wedges when the image is altered have no impact upon the precision when firing occurs. It is however important for the wedges to return to their specified reference positions after firing to ensure the precision of the fire simulator. In order to ensure the precision of the return to the reference position, and to keep the wedges in their reference positions after firing, the deflecting element according to one embodiment comprises means intended for that purpose. These means operate, e.g., magnetically and are disposed in a fixed position.

In one preferred embodiment, the deflecting element comprises exactly two optical wedges, and the control means are arranged to control the rotational positions of the wedges independently of one another, or with a controlled correlation, so as to achieve a given probability distribution. The wedges are thus rotatable relative to one another, and their mutual relationship controls an angle of deflection V for the deflecting element within a range $O<V<V_{max}$. V is vectorial, i.e., it consists of a horizontal and a vertical component. This means that V can vary both in size (amplitude) and direction. In this preferred embodiment with two wedges, the wedges are in the reference position when they are out of phase with one another.

The present invention also concerns a method for optically simulating recoil in a weapon with a sight, characterized in that an altered sight image is produced in the sight before firing, and in that, during firing, the image is brought to an unaltered status. The shooter who is being trained thus experiences the weapon as having jumped due to recoil, and must then aim at the target again.

DETAILED DESCRIPTION OF THE PREFERRED EMBODIMENTS

Figure 1:
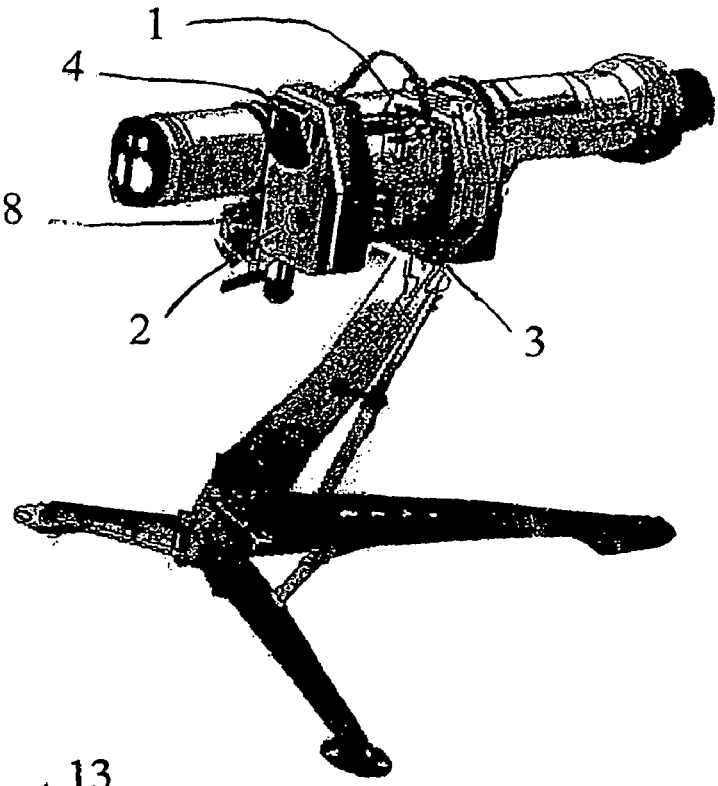
FIG. 1 is a perspective view showing an example of a weapon equipped with a weapon simulator.

Referring to FIG. 1, a simulator 1 contains a transmitter/receiver 2 for laser radiation and a simulator sight 3 equipped with a recoil simulator 9 (FIG. 2), which is not visible behind the protective cover in FIG. 1. The simulator 1 is a simulator intended for a heavier weapon belonging to the category of guided antitank weapons. Guided antitank weapons are characterized in that the shooter looks through the sight, fires at the sighted target, then continues looking through the sight and guides a projectile fired from the weapon throughout its entire flight toward the target. The simulator beam of the weapon simulator is aligned with an aiming axis defined by a crosshair in the simulator sight.

In an alternative embodiment (not shown), the simulator is disposed on the sight and barrel of a weapon, whereupon the simulator beam is aligned with an aiming axis of the weapon defined as the direction in which a round will leave the weapon when it fires live ammunition. The weapon's own sight, which is aligned with the simulator axis, is used instead of a simulator sight in this embodiment.

Figure 2:
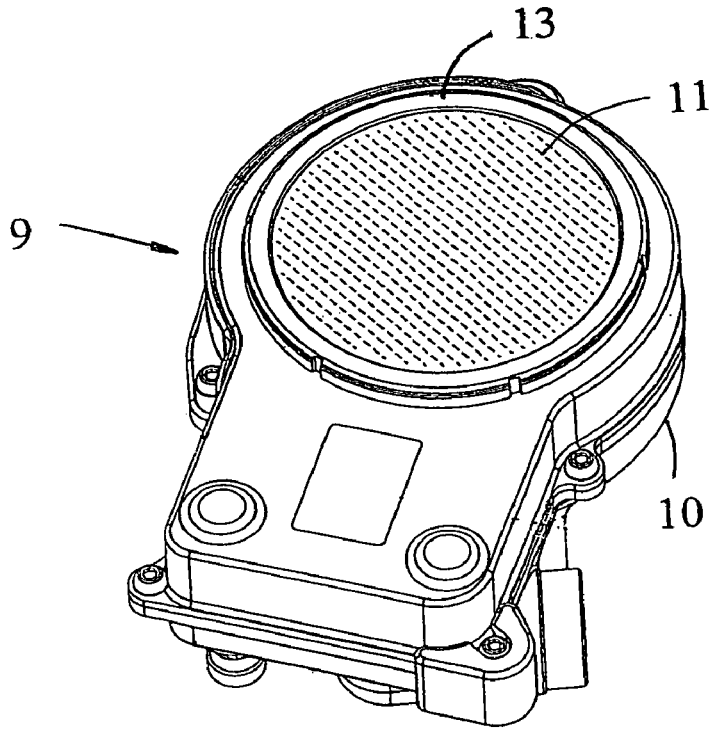
FIG. 2 is a perspective view of an example of a recoil simulator according to the invention.

In FIG. 2, reference number 9 designates a recoil simulating device. The recoil simulating device is mounted behind the protective cover 4 on the sight 3 so that the shooter views a sight image processed by the recoil simulating device 9 when he looks through the sight. The recoil simulating device is thus disposed somewhere in an optical path through the sight.

In one embodiment, the device 9 is disposed in the beam path in front of the optical entrance to the simulator sight. The device 9 can alternatively be mounted inside the sight. However, in this alternative embodiment the device should be mounted in a position such that the beam path is parallel to ensure that the image created by the recoil simulating device is not distorted.

Figure 3:
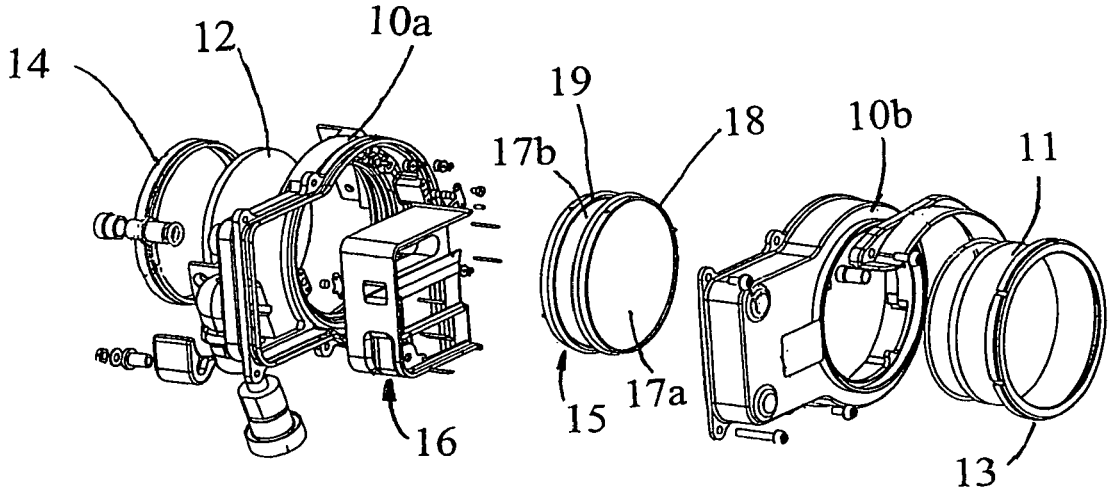
FIG. 3 is an exploded view of the recoil simulator of FIG. 2.

The functional components of the recoil simulating device 9 are enclosed within a divided housing 10, a front window 11 contained in an associated holder 13, and a rear window 12 contained in an associated holder 14 (see FIG. 3). The housing 10 is made of, e.g., aluminum. The windows 11, 12 are arranged to permit visible light to pass through and are made of, e.g., antireflective glass. The housing 10 and the windows 11, 12 seal tight against both moisture and electromagnetic radiation. The enclosure can also be gas-filled with, e.g., nitrogen. A contact device 8 constitutes the electrical interface of the recoil simulator.

In FIG. 3 the housing 10 is divided into two mutually assemblable parts 10*a* and 10*b*. The housing 10 contains a deflecting element 15 and a drive unit 16 arranged to drive the deflecting element 15. The deflecting element 15 comprises two optical wedges 17*a* and 17*b* that are disposed consecutively in the beam path and which are made of, e.g., antireflective glass. The wedges are each glued into their respective wedge holders 18 and 19.

Figure 4:
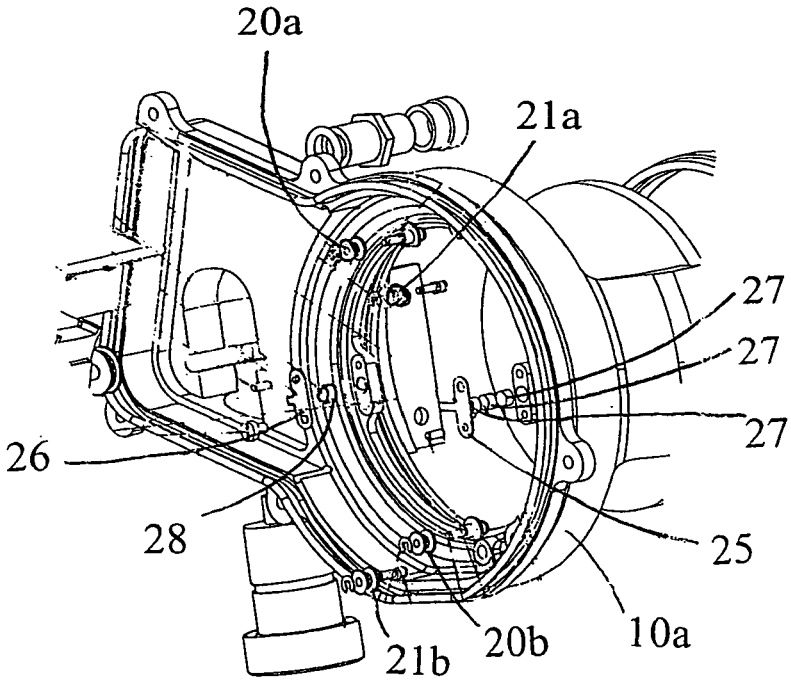
FIG. 4 is an exploded view of a part of the recoil simulator in FIG. 2.

In FIG. 4, each of the two wedge holders is suspended on rollers 20*a*, 20*b*, 20*c* and 21*a*, 21*b* and 21*c* in such a way that the rollers can be set in motion and enable the associated wedge holders to perform a rotational movement. In the described example there are three rollers for each wedge holder, of which two are visible in the view shown in FIG. 4. The rollers form a three-point suspension system for each wedge holder. The system acts on the periphery of the wedge holders via suspension points spaced 120 degrees apart. This is done to provide good suspension stability, and so as not to obscure the optical beam path. In one embodiment the rollers 20*a*, 20*b*, 20*c*, 21*a*, 21*b* and 21*c* each have a radial groove realized around their periphery. For example, the rollers are so-called "V-groove rollers." In the embodiment in which the rollers have a radial groove, the peripheries of the holders 18, 19 have a protruding flange with, e.g., a so-called "full-radius shape" adapted so as to engage the roller grooves. One of the rollers 20*c*, 21*c* (FIG. 6) belonging to each respective holder 18, 19 is a drive wheel, while the remaining rollers 20*a*, 20*b*, and 21*a*, 21*b* act as sleeve-bearing-mounted support wheels. In one embodiment the drive wheels are lined with polyurethane rubber to create adequate friction to transfer torque to the wedge holders. Each respective drive wheel 20*c*, 21*c* is controlled by an associated motor 29, 30 in the drive unit 16, as will be described in more detail below.

Figure 5:
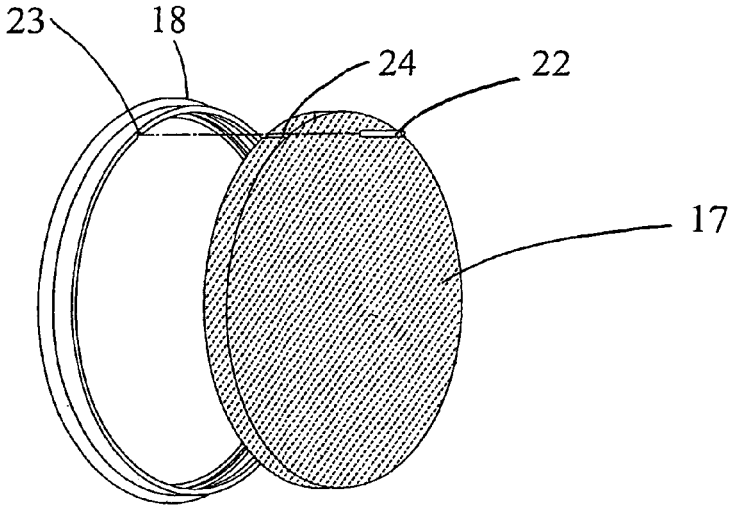
FIG. 5. is an exploded diagram of an optical wedge contained in the recoil simulator.

FIG. 5 depicts one of the arrangements of a wedge holder and its associated optical wedge; both assemblies are identical in the described example. A pin 22 that extends axially from the holder is disposed on the wedge holder 18. In the example shown, the pin is disposed in an opening formed by an axially oriented groove 23 in the holder 18 and an axial groove 24 in the associated wedge 17. The pin is, e.g., cylindrical.

Figure 8:
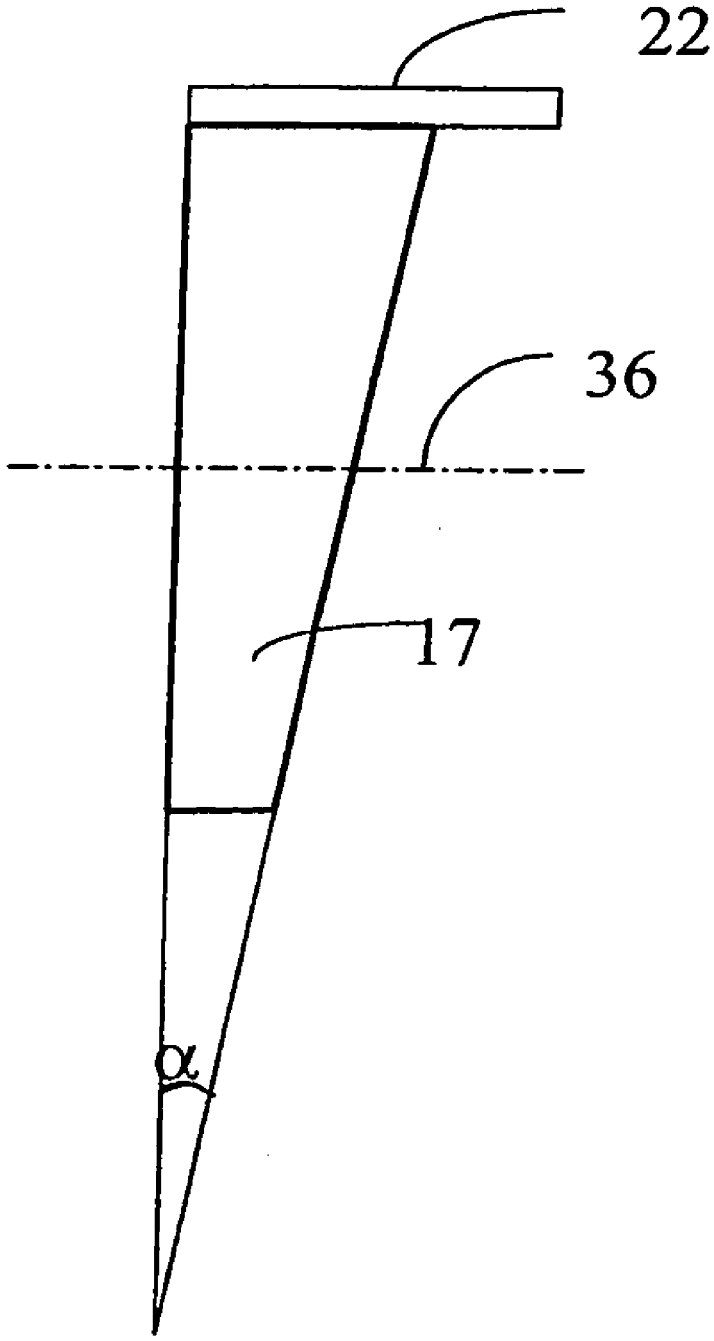
FIG. 8 is a cross-sectional view of the optical wedge of FIG. 5.

FIG. 8 shows that the optical wedge 17 has a cross-section that decreases linearly proceeding from a position on the edge where the pin 22 is disposed and in the direction of an edge opposite the pin. Expressed more simply, the pin 22 is disposed in the location of the thickest end of the wedge, and the varying thickness of the wedge is defined by a value of a wedge angle $\alpha$. In the exemplary case, the two wedges are positioned one after the other along a common center axis 36; they are identical in shape and have the same refractive index. When in this case the thickest ends of both wedges are oriented at a 180° angle relative to one another, i.e., when they are out of phase, the sum of the angles of refraction is zero, and an unaltered image is produced. We designate this position as a reference or zero position. In all other rotational positions of the wedges, the two wedges will refract the light so as to disguise the image. One skilled in the art will perceive that other embodiments involving more than two wedges could also produce the afore-described rotation of the wedges between a reference position, in which an unaltered image is obtained, and a position divergent from the reference position, in which an altered image is obtained.

The pin 22 is made of a magnetic metal or metal alloy, such as a steel alloy. The pin 22 extending from each wedge/wedge holder acts to keep the wedge holder oriented toward an associated magnetic stop. In FIG. 4, each magnetic stop is made of a magnetic sheet 25 and 26 that is in contact with one or more associated magnets 27 and 28. The magnets 27, 28 are, e.g., so-called "miniature magnets." Any potential play between each wedge holder and its stop when the wedges are in their reference position will be eliminated by the magnetic force between the wedge holder and its stop. Because the reference position is unambiguously determined by the placement of the stop, the repetitive accuracy of the system is ensured. The reference position is used when the system is set to fire, i.e., the simulator beam from the transmitter 2 is aligned with the aiming axis of the simulator sight 3, which is defined by the crosshair in the sight.

Figure 6:
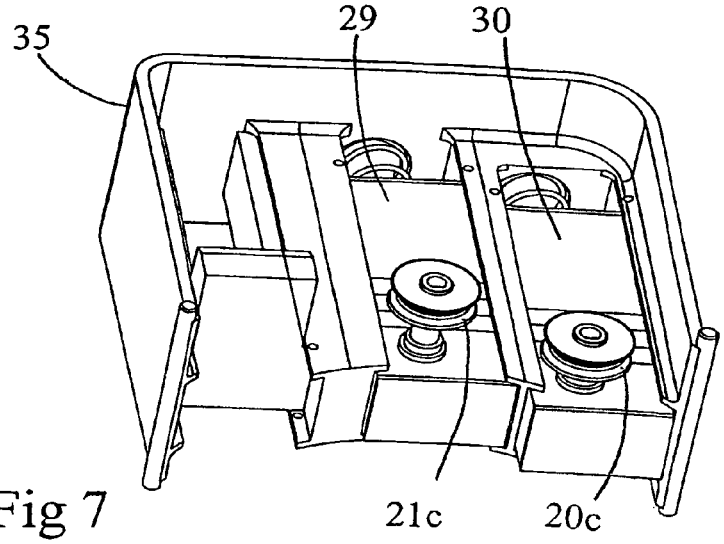
FIG. 6 is a perspective view showing a drive unit contained in the recoil simulator.

Referring to FIG. 6, the two drive motors 29, 30 in the drive unit 16 are spring-loaded and sleeve bearing-mounted in a holder 35. Each drive roller 20*c*, 21*c* is disposed in direct connection with its associated motor 29, 30 via a bearing and angle gear integrated into each respective motor shaft. Motor 29 has a longer shaft connected to drive wheel 21*c* and drives the rear wedge holder 19. Motor 30 has a shorter shaft connected to drive wheel 20*c* and drives the front wedge holder 18.

Figure 7:
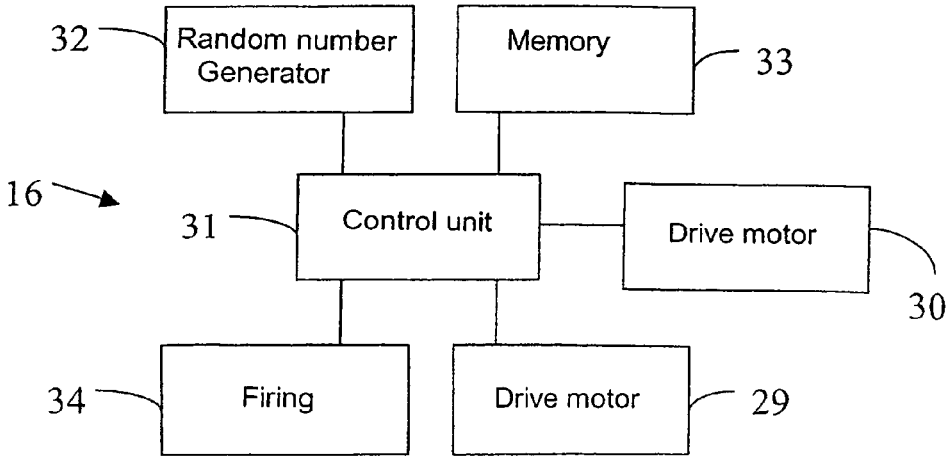
FIG. 7 is a block diagram that illustrates the function of the drive unit of FIG. 6.

In FIG. 7, the drive unit 16 controls the two drive motors 20 and 30 via a control unit 31 connected to both motors 29, 30. The control unit 31 is operatively connected to and supplied with data from a random number generator 32. When activated, the control unit 31 retrieves a random value for each motor from the random number generator 32, which value is then converted into a corresponding signal adapted for the motor, whereby the value from the random number generator determines the duration of the signal. This is done by means of, e.g., a table. The design of the table makes it possible to control the wedges by correlation and, in this way, a particular probability distribution that is typical for a weapon can be achieved.

The durations of the signals or the table values are stored in a memory 33, and the adapted signals for the motors 29 and 30 are fed to the motors, which then rotate their associated wedge holders from their respective reference positions to the positions determined by the durations of the signals. The two optical wedges thus produce a randomly altered sight image in the sight. The signals to the wedge holders are thus adapted so that the wedges are rotatable relative to one another as a function of the calculated rotation ratio of the control unit. This mutual relationship controls an angle of deflection V for the deflecting element within a range $0<V<V_{max}$. V is vectorial, i.e., it consists of a horizontal and a vertical component. The vertical component typically varies within a range 5 mrad$<V_{vertical}<$10 mrad. The horizontal component typically varies within a range −5 mrad$<V_{horizontal}<$+5 mrad. These limits are dimensioned based on the type of weapon to be simulated, and depend on the wedge angle $\alpha$ (FIG. 8), the refractive indices of the wedges and the mechanical rotation ranges of the wedges.

Because the wedges are controlled using a table and by correlation, a probability distribution that corresponds to that of the weapon in question can be achieved, i.e., certain angles (recoils) will be more probable than others, and will occur more often.

To reset the wedge holders with their associated wedges, the control unit 31 is arranged to retrieve the stored positional settings from the memory 33 and apply equally large but opposite signals (reversed polarity) to one another's associated motors in order to bring about rotation back to the reference positions of the respective wedge holders. The afore-described magnetic force holds the wedges in their reference positions even if the recoil simulating device 9 is subjected to jolts or other mechanical effects, and even if electrical voltage is not connected. This is important for maintaining the high precision of the simulator.

The control unit 31 is activated by activating the recoil simulator device 9, whereupon the altered sight image is created in the manner described above. The control unit is moreover connected to a firing mechanism 34 that generates a start pulse in the weapon 2 via the contact device 8 (FIG. 2). The contact device 8 thus also constitutes the electrical interface of the recoil simulator, which is powered through the contact device.

The control unit 31 is arranged, when firing is detected, to guide the wedges to the reference position, in which the sight image is unaltered. The sight image is then kept unaltered until the fire simulator has performed a hit assessment. The control unit is thereafter reactivated to create an altered image in the sight. The new random rotation ratio is calculated by the control unit 31 at the time of each firing. The new rotation thus calculated serves as the basis for the next subsequent alteration of the sight image as soon as the simulation in progress is completed and a hit assessment has been performed.

In an embodiment that is not shown, the recoil simulating device is also equipped with an optical IR sensor/receiver and a pulsed IR diode that emits a pulsed IR beam in order to detect any night-sight filters, equipped with a reflector surface, that are being used in connection with a night sight in darkness or under difficult lighting conditions. The sensor thus senses whether the system is using a day or night channel (different color scales in the sight image).

When the day channel is used, the natural background image is reproduced in the sight, and the red flash effect must not be activated. When the night channel is used, the background image is reproduced as nuances in a red/black color scale in the sight. In this mode a red flash effect must be activated upon firing. The sensor senses the prevailing mode, which is logged by the system. If the night channel is being used, a signal is sent to the simulator sight 3 commanding it to create a red flash upon firing.

The red flash is achieved in that the control unit 31 sends a signal to an obscuration unit in the simulator sight, which obscuration unit consists of a controllable light source, such as a plurality of red LEDs whose light is reflected into the optical beam path of the sight upon activation. This function simulates the excess of heat radiation that occurs when the projectile is fired from the weapon. It causes the night sight to overreact for roughly one second after firing, so that the entire sight image becomes strong red in color during this interval, and the shooter is blinded by red light during this time.

What is claimed is:

1. A device for a weapon sight comprising:

a deflecting element disposed in an optical path through the sight and comprising at least one optical wedge; and means for controlling the positional setting of the at least one optical wedge in order to produce a randomly altered sight image in the sight, wherein the control means include means for producing, prior to firing, the altered sight image and, during firing, means for guiding the at least one optical wedge to a reference position in which the sight image is unaltered.

2. A device according to claim 1, wherein the control means comprise at least one memory arranged to store the current positional setting for each respective wedge.

3. A device according to claim 2, wherein, during firing, the control means includes means for retrieving the stored positional settings from the memory and, for each respective wedge, means for applying an equally large but counter directional displacement to the reference position.

4. A device according to claim 1, wherein the deflecting element includes exactly two optical wedges, and wherein the control means includes means for controlling the rotational positions of the wedges according to one of a random rotational ratio and a correlation that yields a customized probability distribution.

5. A device according to claim 4, wherein the wedges are rotatable relative to one another, and wherein their mutual relationship controls an angle of deflection V for the deflecting element within a range $0<V<V_{max}$, where V is vectorial and includes a horizontal and a vertical component.

6. A device according to claim 4, wherein, in the unaltered reference position, the wedges are out of phase with one another.

7. A device according to claim 1, wherein the deflecting element includes means for holding each at least one wedge in place in the reference position.

8. A device according to claim 7, wherein the means for keeping the wedges in place in the reference position are magnetically operable.

9. A device according to claim 1, wherein the deflecting element includes means for suspending the wedges so that they can perform rotational movements around a center axis.

10. A method for optically simulating recoil in a weapon with a sight, comprising the steps of:

controlling a positional setting of the at least one optical wedge in order to produce a randomly altered sight image in the sight wherein the control includes providing the sight is provided with an altered sight image before firing; and bringing the image to a unaltered status during firing.

11. A method for a weapon sight comprising:

providing at least one optical wedge configured to provide deflection in an optical path through the sight;

controlling the positional setting of the at least one optical wedge in order to produce a randomly altered sight image in the sight; and prior to firing, producing the altered sight image and, during firing, guiding the at least one optical wedge to a reference position in which the sight image is unaltered.

12. A method according to claim 11, further comprising storing the current positional setting for each respective wedge in at least one memory, and during firing, retrieving the stored positional settings from the memory and, for each respective wedge, applying an equally large but counter directional displacement to the reference position.

13. A method according to claim 11, wherein the deflecting element includes exactly two optical wedges, and wherein the controlling step includes controlling the rotational positions of the wedges according to one of a random rotational ratio and a correlation that yields a customized probability distribution.

14. A method according to claim 13, wherein the wedges are rotatable relative to one another, and wherein their mutual relationship controls an angle of deflection V for the deflecting element within a range $0<V<V_{max}$, where V is vectorial and includes a horizontal and a vertical component.

* * * * *